United States Patent [19]

Morisod

[11] Patent Number: 4,713,831

[45] Date of Patent: Dec. 15, 1987

[54] COUNTING METHOD AND DEVICE

[75] Inventor: Jean-Bernard Morisod, Crissier, Switzerland

[73] Assignee: Bobst SA, Switzerland

[21] Appl. No.: 783,175

[22] Filed: Oct. 2, 1985

[30] Foreign Application Priority Data

Oct. 12, 1984 [CH] Switzerland ..... 04893/84

[51] Int. Cl.[4] ..... G06M 7/06

[52] U.S. Cl. ..... 377/8; 235/98 B; 271/262; 340/674; 340/676

[58] Field of Search ..... 377/8; 271/262, 263; 355/14 CU; 340/674, 676

[56] References Cited

U.S. PATENT DOCUMENTS

| | | | |
|---|---|---|---|
| 3,702,925 | 11/1972 | Anderson et al. | 377/8 |
| 4,038,809 | 8/1977 | Preisig | 93/93 M |
| 4,298,790 | 11/1981 | Decker et al. | 377/8 |
| 4,539,470 | 9/1985 | Honegger et al. | 377/8 |

FOREIGN PATENT DOCUMENTS

| | | | |
|---|---|---|---|
| 2446184 | 4/1976 | Fed. Rep. of Germany | 377/8 |
| 123792 | 9/1980 | Japan | 377/8 |
| 862156 | 9/1981 | U.S.S.R. | 377/8 |

*Primary Examiner*—John S. Heyman

*Attorney, Agent, or Firm*—Hill, Van Santen, Steadman & Simpson

[57] ABSTRACT

A counting device for counting the number of objects such as folded box blanks in a flow of folded box blanks characterized by a sensor having a portion engaging a leading edge of a blank in the flow and being moved to activate a pulse generating device. The device also includes an arrangement to lift the portion of the sensor out of engagement after the pulse has been generated to enable resetting the pulse generator and engaging the next following object of the flow.

9 Claims, 6 Drawing Figures

COUNTING METHOD AND DEVICE

BACKGROUND OF THE INVENTION

The present invention is directed to a method and device for counting flat objects such as folded boxes which are arranged in a flow of objects.

Several methods for counting folded boxes, which are moving in a flow of folded boxes, are already known. One of these is to skim an upper part of the flow of folded boxes with a detector finger connected to an electric switch or piezoelectric transducer. Such a counting device is described in the Swiss Pat. No. 588,994 and the counting operation is carried out on the top of the flow of vertically positioned folded boxes. The edges of the successive folded boxes are skimmed by a finger giving an impulse to a counting unit each time it passes over a box edge. The counting operation on such a flow is quite similar to the counting of a flow of overlapping folded boxes forming a flow of boxes arranged in a single like fashion. The upper part of the boxes in the flow that have a shingle-like relationship also show steps corresponding to the spaces between two boxes. Thus, the method in the Swiss patent can be adapted to counting objects in different flow arrangements.

Another commonly used method is to detect each box of a flow by means of a reader or sensor comprising a roller mounted on a lever which is connected to a microswitch. The output of the microswitch is connected to a counting unit or means. If the running speed of the flow remains quite low, these two methods perform very satisfactorily. However, with high speeds, the detecting finger or the roller have a tendency to jump over the folded boxes and the accuracy of the counting becomes very problematical.

SUMMARY OF THE INVENTION

The present invention is directed to a method and device for counting the objects in the flow of objects which provides an accurate counting whatever the running speed of the flow. To achieve these results, the method comprises the steps of providing means for counting the objects in the flow having a detector mounted for movement to create a pulse when moved a specific amount, moving the flow of objects by the means for counting, engaging a leading edge of an object of the flow with the detector as the object moves by to move the detector and create a pulse, processing the pulse, and shifting the detector out of engagement with the edge of the object after creating the pulse to enable engaging the leading edge of the next following object of the flow.

The method is preferably accomplished in a device for counting the number of objects in a flow of objects being moved past a given point, said device including a sensor means for engaging objects in succession and activating first means to create a pulse for each object, which pulses are processed in a memory. The improvements comprise the sensor means having a portion engaging a leading edge of each object in succession with movement of the engaged object in the direction of the flow causing the portion to move and activate the first means to create the pulse, and means for shifting the portion out of engagement with the leading edge after the first means creates the pulse to enable resetting the first means and to engage the edge of the next following object of the flow.

Other objects and advantages of the present invention will be readily apparent from the following description, drawings and claims.

DESCRIPTION OF THE PREFERRED EMBODIMENTS

Figure 1:
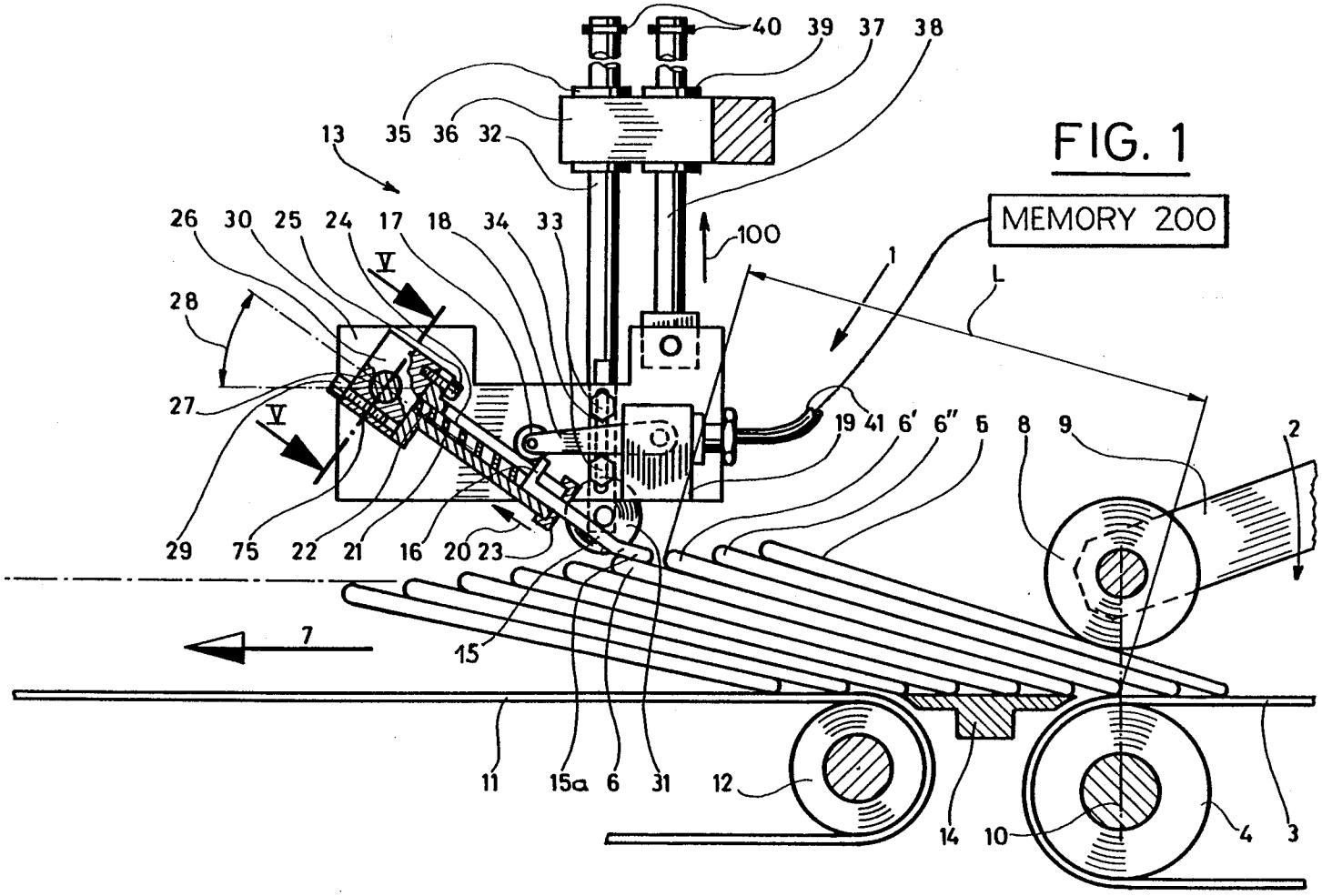
FIG. 1 is a side view of a counting station with portions in cross-section utilizing an improved detector of the present invention.
Figure 2:
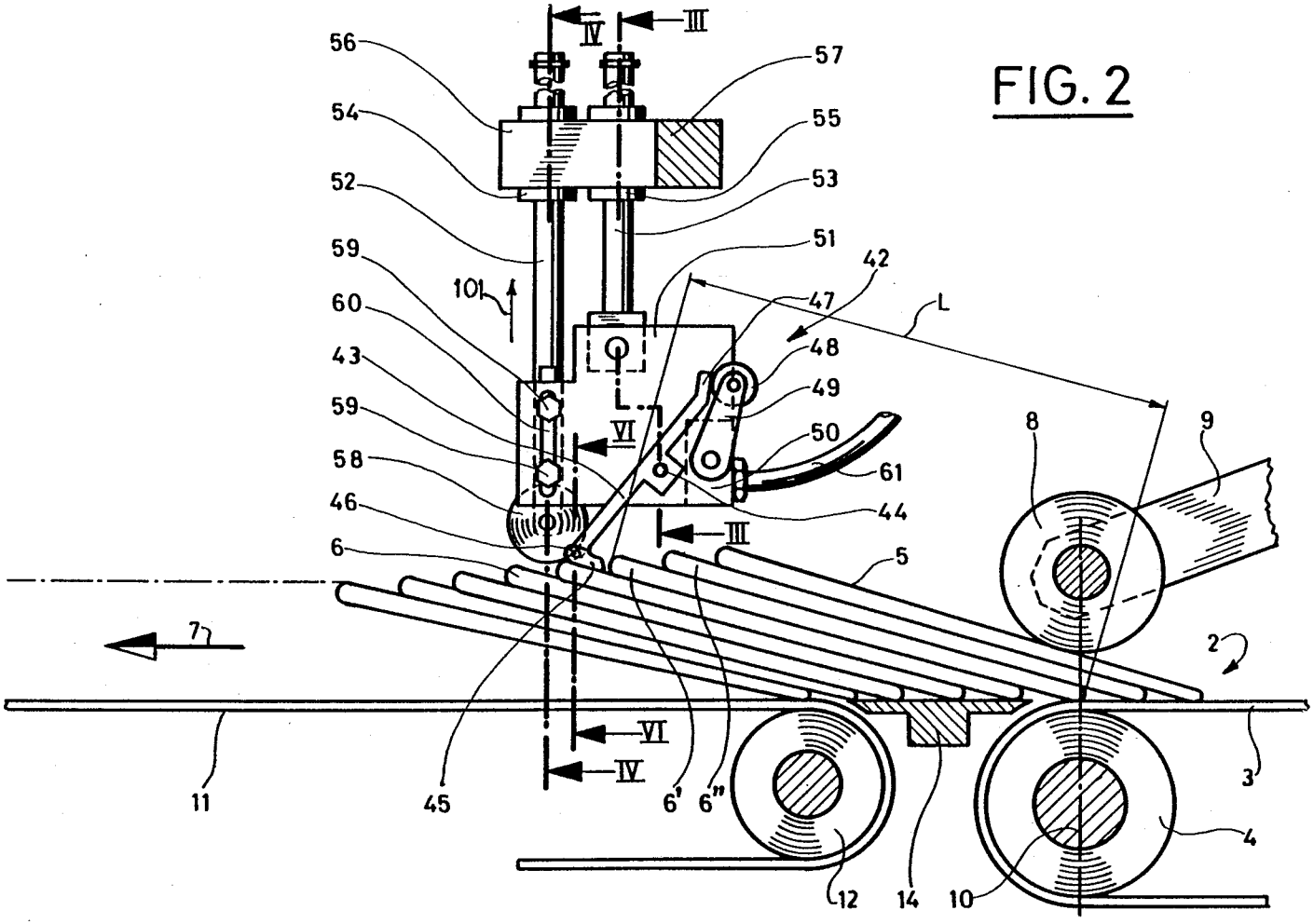
FIG. 2 is a side view of a counting station using an embodiment of the improved detector of the present invention.

The principles of the present invention are particularly useful in a counting station generally indicated at 1 in FIG. 1 and at 42 in FIG. 2. As illustrated in FIG. 1, the counting station 1 is located after a delivery station 2 of a folder gluer device not illustrated. The delivery station 2 includes a conveyor belt 3, which is driven by a roller 4, and the belt 3 is arranged so that it transfers a flow 5 of folded boxes 6 in a direction of the arrow 7. A pressure roller 8 is mounted between a pair of lever arms 9 and is on a vertical axis 10 of the roller 4. A belt conveyor 11 having a roller 12 is used to insure the passage of the flow 5 beneath counting means 13 of the counting station 1. To insure a continuous movement of the flow 5 between the belt 3 and the belt 11, a shelf 14 extends between these two conveyor belts.

Figure 5:
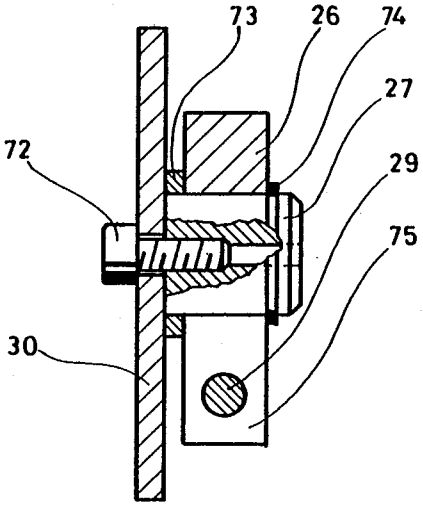
FIG. 5 is a cross-sectional view with portions in elevation and portions broken away for purposes of illustration taken on lines V—V of FIG. 1.

The counting means 13, as illustrated in FIG. 1, includes a sensor element 15, which has a square section or portion with a tip or portion 15*a*. The element has a nose or projection 16 which will engage a roller 17 that is mounted on a lever 18 of a microswitch 19 to actuate the microswitch as the element 15 is moved in the direction of arrow 20 due to engagement of the tip 15*a* with a leading edge of a folded box such as 6'. The sensor 15 is mounted for sliding movement in a guiding rail 21 and movement in the direction of the arrow 20 is opposed by a pressure or compression spring 22 which constantly acts to move the sensor with the projection against a stop 23 at the lower end of the guiding rail 21. The guiding rail 21 as illustrated has an aperture 24 along one side so that the projection or nose 16 can extend therefrom to engage the roller 17. The guiding rail 21 is connected by fasteners such as screws 25 to a support member 26 which in turn is mounted on a axle 27 which is mounted on a plate or cheek 30 by a fastener such as a screw 72 as best illustrated in FIG. 5. The support 26 can be rotated on the axle 27 to vary an angle 28 (FIG. 1) of the track for the sensor 15. To enable the movement of the support 26, it has a slot 75 (FIGS. 1 and 5) and a threaded fastener or screw 29 enables pulling the two portions adjacent the slot 75 together to have the member 26 grip the axle or pin 27. Thus, the working angle 28 for the sensor 15 can be varied infinitely and positioned for the desired thickness and/or angle of the overlapping folded boxes or elements 6 of the flow 5.

The plate or cheek 30 in addition to supporting the rail 21 and the sensor 15 also supports the microswitch 19. A retaining roller 31 is mounted at the proximity of the working place for the sensor or element 15. This roller is mounted at the end of a rod 32 which is secured by screws 33 against one surface of the plate 30. In order to adjust the distance between the curved surface of the roller 31 and the sensor 15, the plate or cheek 30 has an elongated slot 34 through which the screws 33 pass. The rod 32 is mounted to slide in a bearing 35 of a support 36. The support 36 is connected to a cross bar 37 and positions the counter 13 relative to the conveyor 11. To achieve a good guiding of the counting means 13, a second rod 38 is connected to the cheek or plate 30 and is received in a bearing arrangement 39 in the support 36. As illustrated, the upper ends of both the rods 32 and 38 are provided with stop rings 40 to limit the maximum amount of lowering of the counting means 13 toward the conveyor 11. Each of the bearing arrangements 35 and 39 can be a ball bearing arrangement which allows movement of the rods 32 and 38, respectively, along their axis.

Not only is the axle 27 secured by the threaded fastener 72 to the plate 30, but as illustrated in FIG. 5, the axle or support 27 is spaced from the edge of the side of the plate by a spacer 73 and held by a stop or snap ring 74 to prevent its disengagement from the axle 27.

The counting means 13 operates in the following manner: a flow 5 of folded boxes 6 is moved in a continuous mode in the direction of the arrow 7 by the coaction of the conveyor belts 3 and 11. Near the vertical axis 10, the forward shifting of the flow is achieved by the pressure roller 8 to achieve the shingled overlapping relationship illustrated in FIG. 1. The sensor element 15 is pushed in the direction of arrow 20 when a tip **15*a* engages a leading edge of a folded box such as the folded box 6'. The movement of the box 6' in the direction of the arrow 7 moves the element 15 along the guiding rail 21 with the nose 16 engaging the roller 17 to actuate the switch 19 to send the pulse on a line 41 to the conventional memory or counting device 200. When the roller 31, whose gap between its circumference and the end or tip of the sensor 15 has been set with regard to the thickness of the folded box 6 of the flow 5, rides up onto the leading edge of the box 6 which is preceding the box 6', it will shift the tip 15*a* of the sensor 15 from engagement with the leading edge of the box 6' by lifting the entire counting arrangement 13 in a direction of arrow 100. This movement causes the leading edge or tip 15*a* of the sensor 15 to disengage from the leading edge of the box blank 6' and for the compression spring 22 to shift the sensor 15 in a direction opposite to the arrow 20 to reset the microswitch 19. In addition, the lifting in the direction of arrow 100 allows the tip 15*a* of the sensor 15 to be positioned to engage the leading edge of the next following object or folded box 6''. When the sensor 15 shifts in the direction of arrow 20 due to engagement of its free end or tip 15*a* with the leading edge of the box blank 6'', the nose 16 will again actuate the microswitch 19 producing another pulse which is transmitted on the wire or lead 41 to a conventional pulse counter where it is registered. After shifting to trip or engage the roller 17 to actuate the switch 19, the roller 31 will then climb or engage the edge 6' to again lift the counting means to again disengage the edge of the box blank 6''. It should be noted that for this to operate correctly, a proper working angle 28 of the sensor 15 must be set with regard to the thickness of the blanks in the flow 5 and to their angle relative to the plane of the belt 11. In addition, the position of the circumference of the roller 31 relative to the sensor 15 when it has tripped the switch 19 must be selected in order to achieve the lifting of the counting means 13 after actuation of the microswitch 19**.

An embodiment of the counting means is generally indicated at 42 in FIG. 2. In this embodiment, a sensor 43 is mounted to pivot on a pin 44 which mounts it on a cheek or plate 51. The sensor 43 at one end has a portion or shoe 45 pivotaly attached by a pin or axle 46 to the sensor. The other end of the sensor 43 has a form of a bent portion or shoe 47 which acts on a roller 48 attached to a lever 49 of a microswitch 50. The roller 48 is biased against the shoe 47 by a spring (not shown) which may be mounted for instance on a pivot axis of the lever 49 and urges the lever in a counterclockwise direction. As in the previous embodiment, the microswitch 50 is mounted on a surface of the plate 51 and is connected by a lead or cable 61 to a conventional counter. The plate 51 is secured to two sliding rods 52 and 53, which are received in bearing arrangements 54 and 55 for vertical movement in a support 56 which is mounted on a cross bar or frame member 57. As in the previous embodiment, the rods move in their respective bearing arrangements 54 and 55 in a vertical direction and the bearing arrangements may be a ball bearing arrangement which allows movement in the direction of the axis of each of the rods 52 and 53.

The rod 52 at its lower end is provided with a retaining roller 58 and the rod 52 can be adjusted relative to the plate 51 by the fasteners 59 that extend through an elongated slot 60 so that the gap between the portion or shoe 45 and the periphery of the roller 58 can be changed to compensate for changes in the thickness of the folded boxes 6 of the flow 5.

As in the embodiment of FIG. 1, the portion 45 will engage an edge of a blank such as the leading edge of the folded box blank 6' to pivot the sensor 43 to cause the shoe 47 to engage the roller 48 and pivot the arm 49 in a clockwise direction to actuate the switch 50. This will cause a creation of a pulse which is transferred on a lead 61 to the pulse counter. With the proper selection of the position of the roller 58, it will ride up on the blank 6 which is immediately preceding the blank 6' to raise the counting means 42 in the direction of arrow 101 to enable disengaging the leading edge of the blank 6'. During this lifting, the portion 45, which is disengaged, will also move into a position for engaging the leading edge of the next following blank 6'' and the microswitch 50 will be reset. Thus, the counting system functions in the same manner in both cases. It should also be noted that both operations refer to the length positioning of the sensor with regard to the vertical axis 10 which depends on the length L of the folded boxes which are being processed. This term is absolutely requested for proper driving of the flow.

Figure 3:
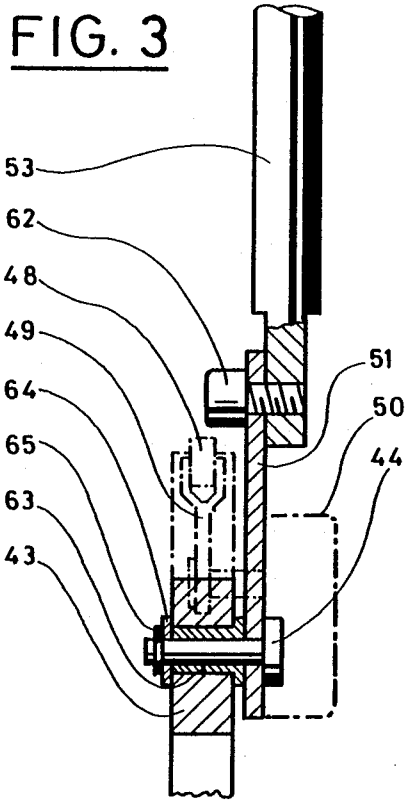
FIG. 3 is a cross-sectional view with portions in elevation taken on lines III—III of FIG. 2.

As best illustrated in FIG. 3, the rod 53 is secured to a side of the plate 51 with a screw 62. The securing of the rod 38 of the embodiment of FIG. 1 to the plate 30 is substantially the same. As illustrated in FIG. 3, the pivoting sensor 43 is mounted on a surface of the plate 51 by means of an axle 44 which has a bushing 63 that spaces the member 43 from the surface of the plate 51. To maintain the member 43 on the bushing 63, a washer 64 and a stop ring or snap ring 65 are provided.

Figure 4:
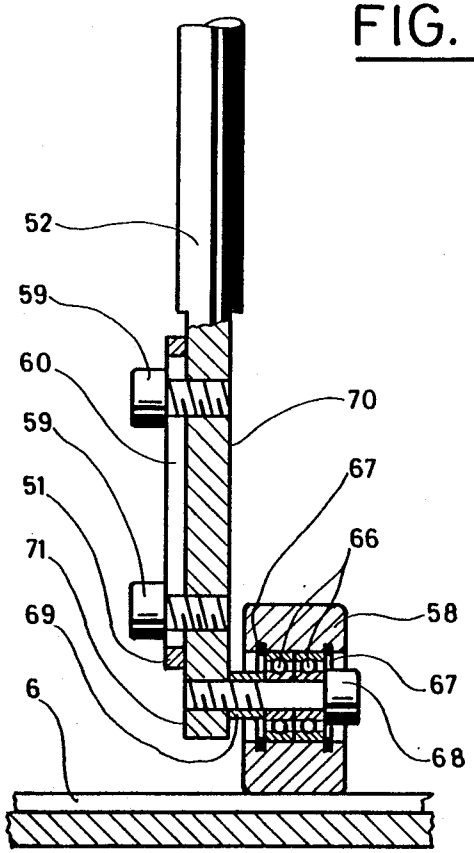
FIG. 4 is a cross-sectional view with portions in elevation taken on lines IV—IV of FIG. 2.

As best illustrated in FIG. 4, the retaining roller 58 is mounted on two ball bearings 66 by lateral stop rings 67. A screw 68 passes through the inner races of the two ball bearings and is secured into the rod 52. To maintain the proper spacing, a spacer 69 extends between a machined flat surface 70 of the rod 52 and the inner race of one of the bearings 66. Opposite to the machined flat surface 70, a second machined surface 71 is formed on the rod and acts as a resting surface for engaging a surface of the plate 51 when the screws 59 are tightened. The Figure also illustrates how the screws 59 extend through the slot 60 to enable for the vertical positioning of the axis of the roller 58 relative to plate 51. It should be noted that the mounting of the roller 31 of the embodiment of FIG. 1 is substantially the same.

Figure 6:
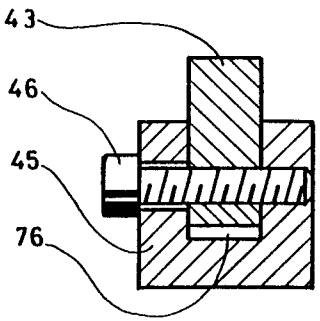
FIG. 6 is a cross-sectional view with portions in elevation taken along lines VI—VI of FIG. 2.

The portion or element 45 which is mounted at the end of the sensor 43 by the pin 48 is best illustrated in FIG. 6. Preferably, the portion 45 has a notch or slot 76 machined therein which has the thickness of the pivoted sensor 43. By tightening the screw 46 that forms the pivot, the angle or position of the member 45 on the element 43 can be determined. This method of mounting has the advantage of offering a perfect secure passage from one folding box to the other so that an accurate counting of the folded boxes in a flow running at high speed can be expected despite the simplicity and low cost of the means used for carrying out the operation.

Although various minor modifications may be suggested by those versed in the art, it should be understood that I wish to embody within the scope of the patent granted hereon, all such modifications as reasonably and properly come within the scope of my contribution to the art.

I claim:

1. In a device for counting the number of objects in a flow of objects being moved past a given point, said device including sensor means for engaging the objects in succession and activating first means to create a pulse for each object, which pulse is processed in a memory with the improvements comprising the device including a plate and a conveyor with a belt for moving the flow of objects along a plane beneath the sensing means, said sensor means having a portion engaging the leading edge of each object in succession with movement of the engaged object in the direction of the flow causing the portion to move and activate the first means to create the pulse, and means for shifting the first means and sensor means to lift the portion out of engagement with the edge after creating the pulse to enable resetting the first means for forming the pulse and to engage an edge of the next following object of the flow, said means for shifting including means mounting the plate for movement along a path extending substantially perpendicular to the plane of the belt, said means for mounting including a pair of rods secured to the plate, said rods being mounted in a bearing arrangement on a frame of the conveyor for movement along the axis of the rods, one of said rods supporting a roller riding on the flow of objects so that as the roller moves over a leading edge of each object, the plate and rods are shifted perpendicularly away from the flow.

2. In a device according to claim 1 wherein the sensing means include a guiding rail, a sensor element having a nose at one end and the portion at a tip of the opposite end, said element being received for sliding movement in the guiding rail, spring means for biasing the sensing element towards the flow, means for mounting the rail for rotation around a pin secured to the plate so that the nose engages the first means to activate the first means as the leading edge of the object pushes the sensing element against the spring means, said means for mounting the rail enable adjusting the angle of the rail and element relative to the flow of objects.

3. In a device according to claim 2, wherein the first means comprises a microswitch having a lever engaged by the nose of the sensor.

4. In a device according to claim 1, wherein the sensing means comprises a sensor element mounted on the plate for movement around an axle, said portion being provided at one end of the sensor element as an adjustable member for engaging the leading edge of the stack.

5. In a device according to claim 4, wherein the adjustable member has a notch for receiving the end of the sensor element and held by a threaded fastener so that the adjustable member can be secured on the arm at the desired angle thereto.

6. In a device according to claim 4, wherein the sensor element has a shoe at an end opposite the adjustable member, said first means being mounted on the plate for engagement by the shoe as the lever is pivoted on the axle.

7. In a device according to claim 6, wherein the first means is a microswitch having a lever engaging said shoe.

8. In a device for counting a number of folded box blanks in a flow of folded box blanks which are arranged in a shingled fashion as they are moved past a given point, said device including sensor means for engaging each of the box blanks in succession and activating first means to create a pulse for each box blank, which pulse is processed in a memory, the improvements comprising said sensor means having a portion engaging a leading edge of each box blank in succession with movement of the engaged box blank in the direction of the flow causing the portion to move and activate the first means to create the pulse, and means for shifting the sensor means and first means to lift the portion out of engagement with the edge after creating the pulse to enable resetting the first means for forming the pulse and to engage an edge of the next following box blank of the flow, said means for shifting including a vertically extending shaft, a plate being secured to the shaft and a roller being mounted on the shaft and moving over the leading edges of the flow of box blanks, the sensing means comprising a guide rail, an element having the portion at one end and a shoe at the opposite end, said element being mounted for sliding movement in the guide rail, and spring means for urging the portion into engagement with the leading edges of the flow of box blanks, said sensing means being secured to the plate with said guide rail being mounted for rotatable adjustable movement on an axle extending from said plate with the nose being positioned for engaging the first means as the element is shifted along the rail by the engaged box blank so that as the roller rides over a leading edge of a blank, it lifts the plate and sensing means to shift the portion out of engagement with the edge.

9. In a device for counting a number of folded box blanks in a flow of folded box blanks which are arranged in a shingled fashion as they are moved past a given point, said device including sensor means for engaging each of the box blanks in succession and activating first means to create a pulse for each box blank, which pulse is processed in a memory, the improvements comprising said sensor means having a portion engaging a leading edge of each box blank in succession with movement of the engaged box blank in the direction of the flow causing the portion to move and activate the first means to create the pulse, and means for shifting the sensor means and first means to lift the portion out of engagement with the edge after creating the pulse to enable resetting the first means for forming the pulse and to engage an edge of the next following box blank of the flow, said means for shifting including a vertically extending shaft, a plate secured to the shaft and a roller mounted on the shaft and moving over the leading edges of the flow of box blanks, said sensing means including an element having said portion provided at one end and a shoe at the opposite end, said sensing means being secured to said plate by said element being mounted for rotation about an axle on said plate, said shoe engaging the first means as the portion is shifted to rotate the element on the axle by the movement of the engaged blank so that as the roller rides over a leading edge of a blank, it lifts the plate and sensing means to shift the portion out of engagement with the edge.

* * * * *